US007107743B2

(12) United States Patent
Suolahti

(10) Patent No.: US 7,107,743 B2
(45) Date of Patent: Sep. 19, 2006

(54) WRAPPING MACHINE

(75) Inventor: Yrjo Suolahti, Marku (FI)

(73) Assignee: Oy M. Haloila AB, Masku (FI)

( * ) Notice: Subject to any disclaimer, the term of this patent is extended or adjusted under 35 U.S.C. 154(b) by 0 days.

(21) Appl. No.: 10/933,534

(22) Filed: Sep. 3, 2004

(65) Prior Publication Data

US 2005/0050861 A1 Mar. 10, 2005

(30) Foreign Application Priority Data

Sep. 5, 2003 (FI) ..... 20031269

(51) Int. Cl.
*B65B 41/16* (2006.01)

(52) U.S. Cl. ..... 53/556; 53/389.4

(58) Field of Classification Search ..... 53/556, 53/588, 389.4; 425/66
See application file for complete search history.

(56) References Cited

U.S. PATENT DOCUMENTS

| | | | | |
|---|---|---|---|---|
| 3,985,277 A | | 10/1976 | Wright | |
| 4,590,746 A | * | 5/1986 | Humphrey | 53/556 |
| 4,718,219 A | * | 1/1988 | Schmitz | 53/556 |
| 4,729,213 A | * | 3/1988 | Raes | 56/341 |
| 4,862,678 A | * | 9/1989 | Humphrey | 53/556 |
| 5,014,489 A | * | 5/1991 | Terminella et al. | 53/51 |
| 5,414,979 A | * | 5/1995 | Moore et al. | 53/556 |
| 5,862,647 A | | 1/1999 | Scherer et al. | |
| 5,875,616 A | | 3/1999 | Paavola et al. | |
| 6,082,081 A | | 7/2000 | Mucha | |

FOREIGN PATENT DOCUMENTS

| | | |
|---|---|---|
| EP | 0 220 712 A1 | 5/1987 |
| EP | 0 289 092 | 11/1988 |
| EP | 1 019 288 B1 | 6/2002 |
| EP | 1 327 583 A1 | 7/2003 |
| EP | 1524192 A1 | 4/2005 |
| FI | 101282 B | 5/1998 |

* cited by examiner

*Primary Examiner*—Scott A. Smith
*Assistant Examiner*—Gloria R. Weeks
(74) *Attorney, Agent, or Firm*—Lowe Hauptman & Berner, LLP

(57) ABSTRACT

A wrapping machine having a pre-stretching device including a first pre-stretching roller and a second pre-stretching roller, which are tractively coupled via power transmission gears. A first deflecting pinch roller has been fitted to be pressed against the first pre-stretching roller to form a first nip for the film web passed between the first deflecting pinch roller and the first pre-stretching roller. A second deflecting pinch roller has been fined to be pressed against the second pre-stretching roller to form a second nip for the film web passed between the second deflecting pinch roller and the second pre-stretching roller. A lever mechanism moves the first pre-stretching roller between an engagement position and a disengagement position, so that the lever mechanism also moves the first deflecting pinch roller apart from the first pre-stretching roller and simultaneously the second deflecting pinch roller apart from the second pre-stretching roller to allow easier thread-in of the film web end.

20 Claims, 4 Drawing Sheets

WRAPPING MACHINE

RELATED APPLICATIONS

Figure 1:
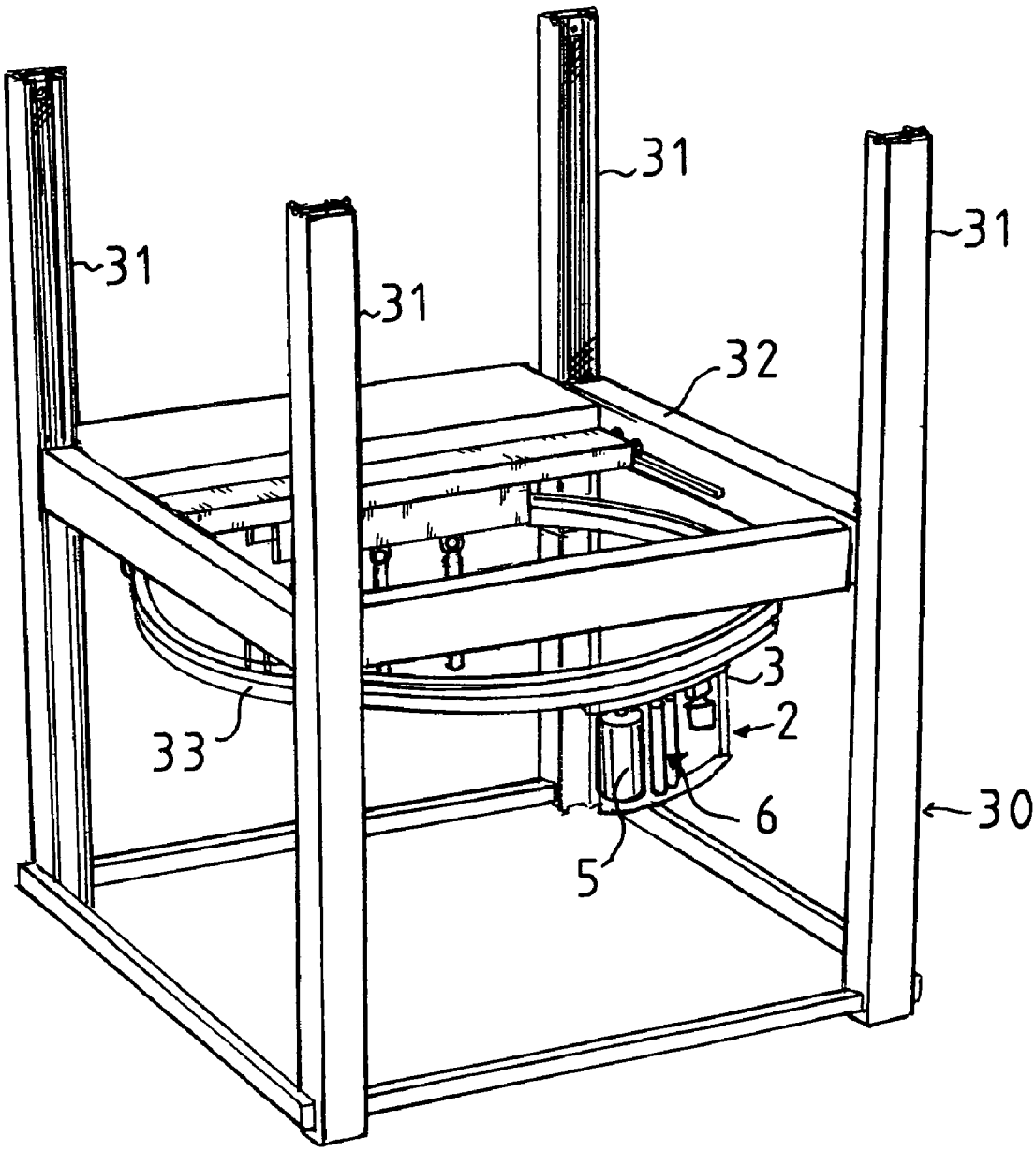

The present application is based on, and claims priority from, Finnish Application Number 20031269, filed Sept. 5, 2003, the disclosure of which is hereby incorporated by reference herein in its entirety.

FIELD OF THE INVENTION

The present invention relates to a wrapping machine as defined in the preamble of claim 1.

BACKGROUND OF THE INVENTION

In prior art, a wrapping machine as defined in the preamble is known from specification U.S. Pat. No. 5,875,616.

Specification U.S. Pat. No. 5,875,616 discloses a wrapping machine for winding a wrapping film web around an object to be packaged. The wrapping machine comprises a film dispenser, which comprises a frame. The frame is provided with supporting elements for rotatably supporting a film web roll on the frame.

The film dispenser comprises a pre-stretching device connected to the frame for pre-stretching the film web drawn from the film web roll before its being wrapped around the object. The pre-stretching device comprises a first pre-stretching roller, with the outer surface of whose rim the first side of the film web drawn from the roller can be brought into a tractive frictional contact. The pre-stretching device further comprises a second pre-stretching roller mounted with bearings on the frame so as to be rotatable at a distance from the first pre-stretching roller to form a first gap between them. The second side of the film web drawn from the roller can be brought into a tractive frictional contact with the outer surface of the rim of the second pre-stretching roller. The pre-stretching device further comprises a first transmission gear, which is mounted on the shaft of the first pre-stretching roller, and a second transmission gear, which is mounted on the shaft of the second pre-stretching roller and fitted to be in tractive contact with the first transmission gear to produce a transmission ratio so as to differentiate the circumferential velocities of the first and second pre-stretching rollers.

The film dispenser further comprises a first deflecting pinch roller, which is fitted to be pressed against the first pre-stretching roller to form a first nip for the film web passed between the first deflecting pinch roller and the first pre-stretching roller. In addition, the film dispenser comprises a second deflecting pinch roller, which is fitted to be pressed against the second pre-stretching roller to form a second nip for the film web passed between the second deflecting pinch roller and the second pre-stretching roller.

The frame of the film dispenser according to specification U.S. Pat. No. 5,875,616 is divided into two sections, a fixed section and an openable and closeable gate section pivotally connected to it and forming a sort of lever mechanism, the first pre-stretching roller and one of the deflecting pinch rollers being mounted with bearings on the gate section. The second pre-stretching roller and the second deflecting pinch roller are rotatably mounted with bearings on the fixed frame. The section part can be moved between an engagement position and a disengagement position. In the engagement position, the power transmission wheels of the pre-stretching rollers are in driving engagement with each other. In the disengagement position, when the gate section is open, the power transmission wheels are disengaged from each other. In the disengagement position with the gate section open, the first gap between the pre-stretching rollers is naturally larger than the corresponding first gap in the engagement position. Due to the openable gate section, the feed-in of the end of the film web from the film web roll through such a pre-stretching device can be easily implemented.

A problem with this prior-art solution is, however, that the film dispenser provided with an openable gate section is fairly big and heavy. In addition, the structure is expensive and relatively complicated.

To solve the problem relating to the feed-in of the film end, other solutions have also been developed, e.g. as disclosed in specification EP 1019288 B1. The ends of the pre-stretching rollers are provided with tapered extensions allowing the film web end crinkled into the form of a narrow strip to slide over the extensions, which guide the strip onto the pre-stretching rollers.

A problem with the structure according to this EP patent is that the extensions of the rollers increase the size of the film dispenser in the vertical direction.

OBJECT OF THE INVENTION

The object of the present invention is to overcome the above-mentioned drawbacks.

A specific object of the invention is to disclose a wrapping machine in which the end of the film can be easily fed in via deflecting pinch rollers and pre-stretching rollers without a need to divide the frame of the film dispenser into a fixed part and an openable part or to provide any tapered extensions at the ends of the pre-stretching rollers.

A further object of the invention is to disclose a wrapping machine in which the film dispenser has as compact a size in the vertical direction as possible and is light, simple and cheap.

BRIEF DESCRIPTION OF THE INVENTION

The wrapping machine of the invention comprises a film dispenser comprising a frame, supporting elements for rotatably supporting a film web roll on the frame, and a pre-stretching device connected to the frame for pre-stretching the film web drawn from the film web roll before it is wrapped around the object. The pre-stretching device comprises a first pre-stretching roller, with the outer surface of whose rim the first side of the film web drawn from the roller can be brought into tractive frictional contact. The pre-stretching device further comprises a second pre-stretching roller, which is mounted with bearings on the frame so as to be rotatable at a distance from the first pre-stretching roller to form a first gap between them, with the outer surface of the rim of which second pre-stretching roller the second side of the film web can be brought into a tractive frictional contact. The pre-stretching device further comprises a first transmission gear, which is mounted on the shaft of the first pre-stretching roller. The pre-stretching device further comprises a second transmission gear, which is mounted on the shaft of the second pre-stretching roller and fitted to be in driving contact with the first transmission gear to produce a transmission ratio so as to differentiate the circumferential velocities of the first and second pre-stretching rollers. The film dispenser further comprises a first deflecting pinch roller, which is fitted to be pressed against the first pre-stretching roller to form a first nip for the film web passed between the first deflecting pinch roller and the first pre-stretching roller. The film dispenser further comprises a second deflecting pinch roller, which is fitted to be pressed against the second pre-stretching roller to form a second nip for the film web passed between the second deflecting pinch roller and the second pre-stretching roller. A lever mechanism has been arranged to move the first pre-stretching roller between an engagement position and a disengagement position. In the engagement position, the transmission gears are in driving contact with each other, while in the disengagement position the transmission gears are disengaged from each other so that the pre-stretching rollers can be rotated independently of each other and in which disengagement position the first gap between the pre-stretching rollers is larger than the first gap in the engagement position.

According to the invention, when the lever mechanism is moved from the engagement position to the disengagement position, the lever mechanism has been fitted to move the first deflecting pinch roller apart from the first pre-stretching roller to form a second gap between the first deflecting pinch roller and the first pre-stretching roller, and to simultaneously move the second deflecting pinch roller apart from the second pre-stretching roller to form a third gap between the second deflecting pinch roller and the second pre-stretching roller, the first, second and third gaps being thus increased simultaneously by a single movement of the lever mechanism.

The invention has the advantage that an enlargement of all the gaps between the pre-stretching and deflecting pinch rollers is achieved by one and the same simple movement of the lever mechanism so as to allow easier feed-in of the film end. The end of the film web can be easily threaded in because all the rollers are separately rotatable and gaps of a suitable width are provided between them. The lever mechanism can be fitted in a very small space between the rollers and the frame, so a film dispenser provided with a lever mechanism according to the invention is not very high.

In an embodiment of the wrapping machine, the film dispenser comprises a power means provided with a rotating shaft and connected to the frame. The film dispenser further comprises power transmission means for transmitting power from the shaft to rotate the second pre-stretching roller. In this case, the second pre-stretching roller is the driven roller.

In an embodiment of the wrapping machine, the lever mechanism comprises a reversal lever, which is pivoted on the frame so that it can turn about a first swivel axis, the first pre-stretching roller being rotatably mounted with a bearing on said reversal lever at a distance from the first reversal lever.

In an embodiment of the wrapping machine, the reversal lever comprises an elongated first swinging arm, which extends to a distance from the first swivel axis to serve as a grip handle for manual operation of the reversal lever. Manual operation of the lever mechanism is advantageous because in a moving film dispenser it is desirable to minimize the number of actuators. Of course, it is also possible to provide an actuator to operate the lever mechanism.

In an embodiment of the wrapping machine, the first deflecting pinch roller is connected to a second swinging arm, which is pivotally connected to the frame so as to be turnable about a second swivel axis, and that the reversal lever comprises a first transmission element for translating the swinging motion of the reversal lever into a swinging motion of the second swinging arm.

In an embodiment of the wrapping machine, the second deflecting pinch roller is connected to a third swinging arm, which is pivotally connected to the frame so as to be turnable about the second swivel axis, and that the reversal lever comprises a second transmission element for translating the swinging motion of the reversal lever into a swinging motion of the third swinging arm.

In an embodiment of the wrapping machine, the first transmission element and/or the second transmission element are/is a pin or the like extending from the reversal lever to the path of the turning motion of the second swinging arm and/or the third swinging arm at a distance from the second swivel axis of the second swinging arm and/or the third swinging arm so that the aforesaid pin or the like pushes the swinging arm concerned when the reversal lever is being turned from the engagement position to the disengagement position.

In an embodiment of the wrapping machine, a spring is fitted to impose a load on the second swinging arm to press the first deflecting pinch roller against the first pre-stretching roller, and that the same spring is fitted to impose a load on the third swinging arm to press the second deflecting pinch roller against the second pre-stretching roller, the spring thus functioning as a return spring to pull back the second swinging arm and the third swinging arm when the reversal lever is turned from the disengagement position to the engagement position.

LIST OF FIGURES

Figure 2:
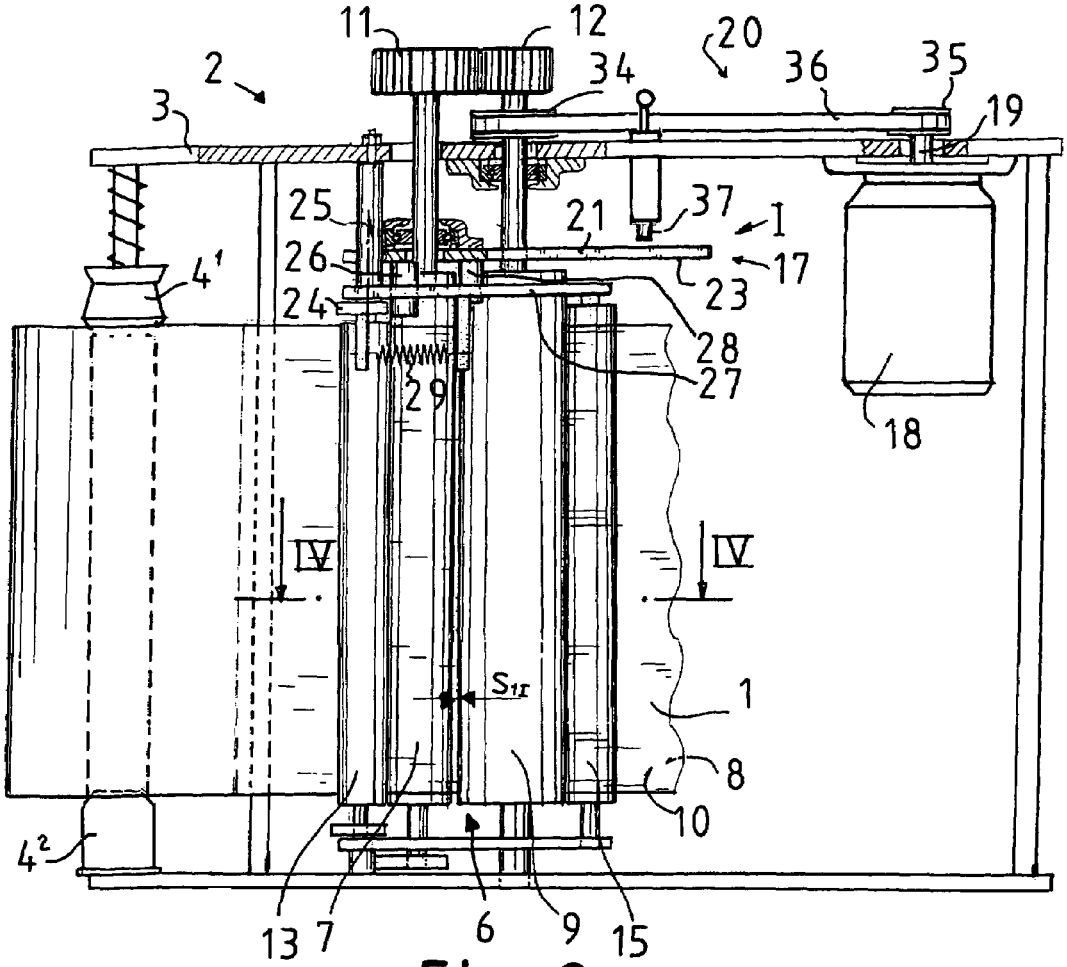
Figure 3:
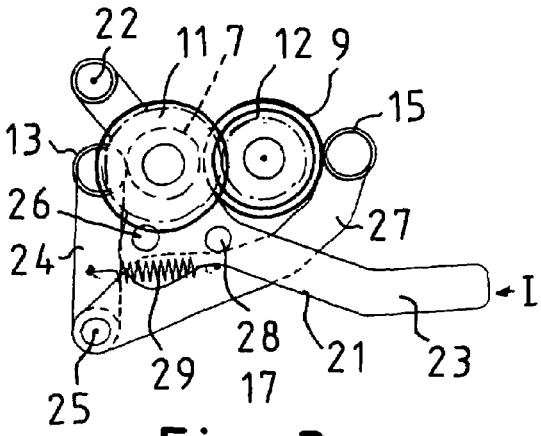
Figure 4:
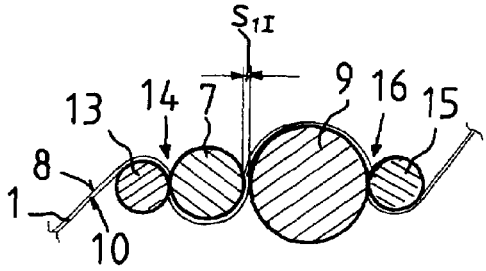
Figure 5:
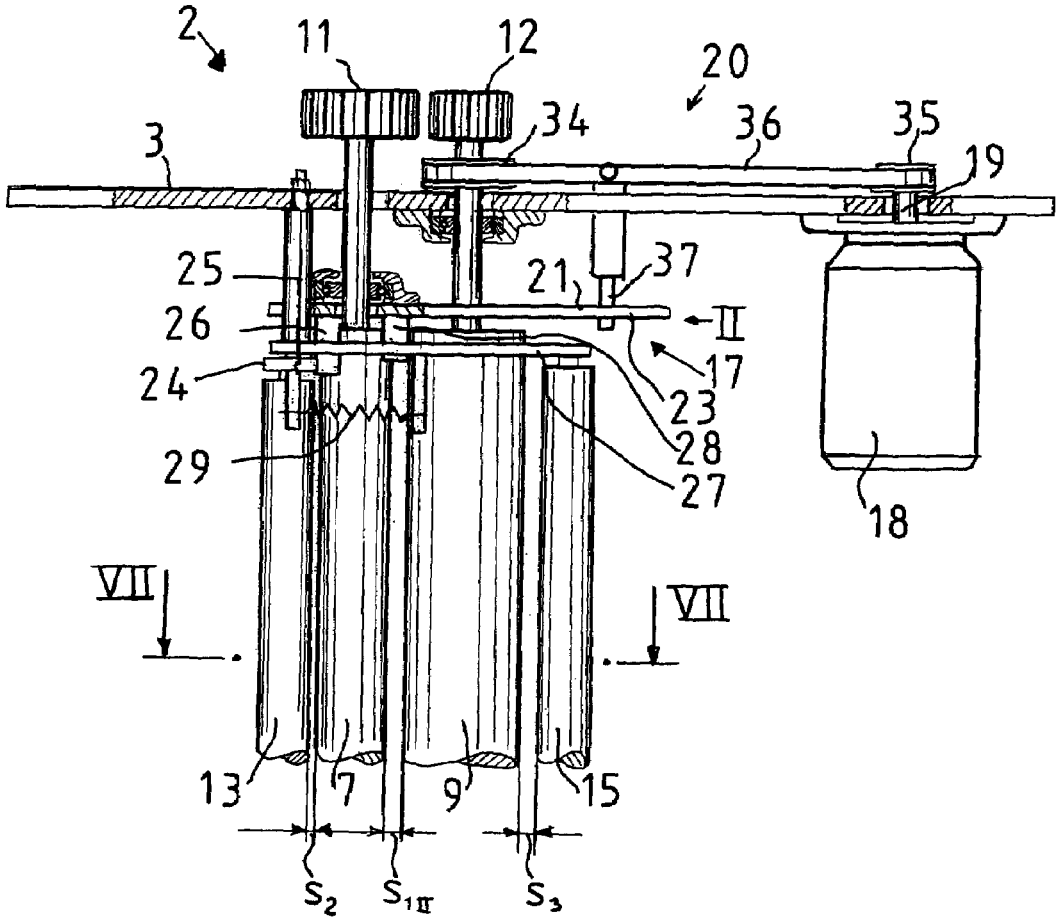
Figure 6:
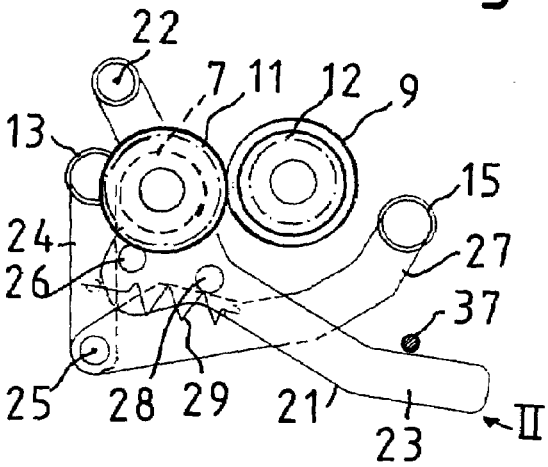
Figure 7:
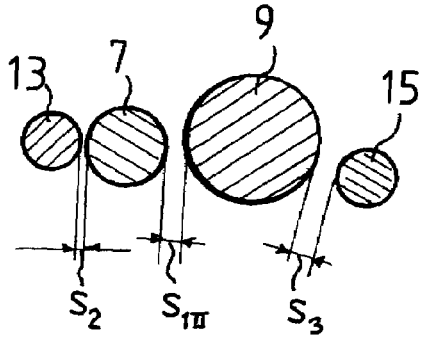
Figure 8:
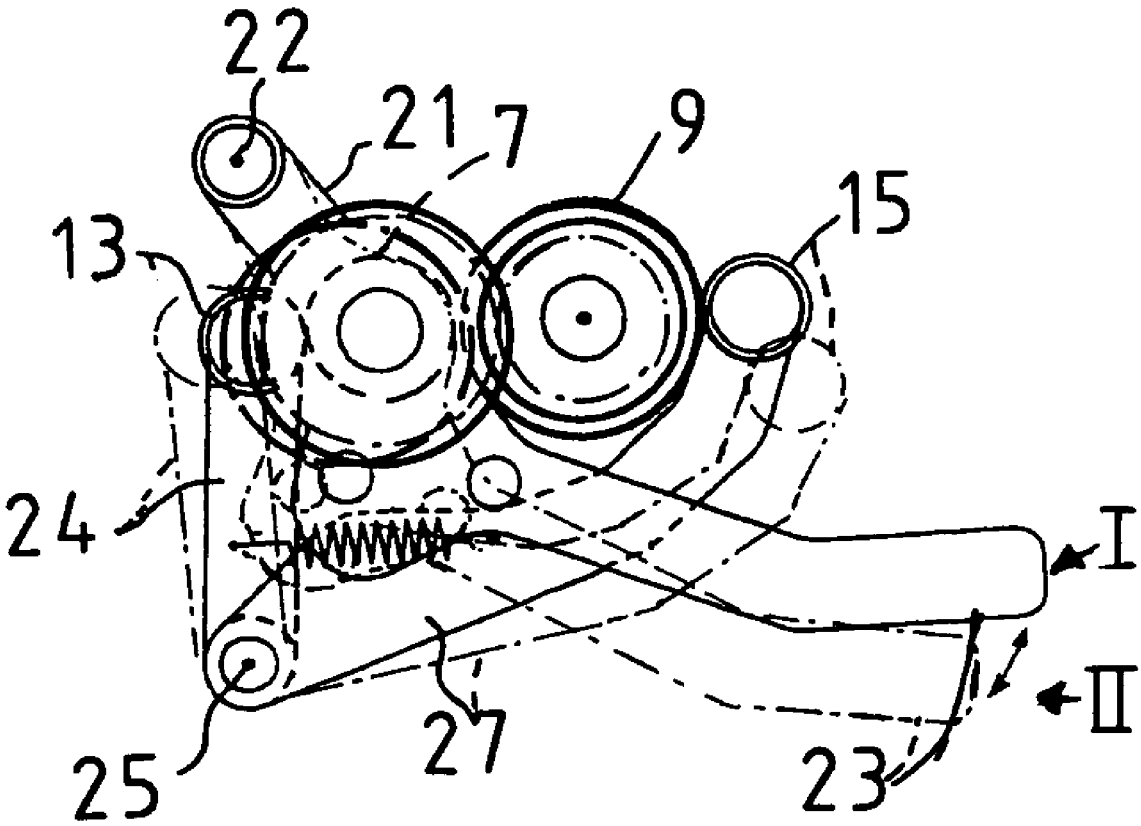

In the following, the invention will be described in detail with reference to embodiment examples and the attached drawings, wherein FIG. 1 presents axonometric view of an embodiment of the wrapping machine of the invention as seen obliquely from above, FIG. 2 presents a diagrammatic side view of the film dispenser of the wrapping machine of the invention in the engagement position, FIG. 3 presents a diagrammatic top view of the lever mechanism, pre-stretching and deflecting pinch rollers and the power transmission wheels when the lever mechanism is in the engagement position, corresponding to the situation illustrated in FIG. 2, FIG. 4 presents a diagrammatic section IV—IV taken through FIG. 2, FIG. 5 presents a part of the film dispenser in FIG. 2 in the disengagement position, FIG. 6 presents a diagrammatic top view of the lever mechanism, the pre-stretching and deflecting pinch rollers and the power transmission wheels with the lever mechanism in the disengagement position, corresponding to the situation in FIG. 5, FIG. 7 presents a diagrammatic section VII—VII through FIG. 5, and FIG. 8 presents FIGS. 3 and 6 drawn one over the other, the engagement position being depicted in solid lines and the disengagement position in dot-and-dash lines.

DETAILED DESCRIPTION OF THE INVENTION

FIG. 1 presents a wrapping machine for wrapping a wrapping film web 1 around an object (not shown) to be packaged.

The wrapping machine 1 comprises a machine frame 30, which is supported on a fixed floor. The machine frame 30 comprises four vertical upright columns 31 at a distance from each other in a rectangular arrangement such that each upright column 31 is located at a corner of an imaginary rectangle. A lifting frame 32 has been arranged to be movable upwards and downwards in a vertical direction by means of a hoisting motor (not shown).

A film dispenser 2, on which a film web roll 5 can be rotatably supported, guided by a ring arrangement 33, has been arranged to circulate on a circular path around the object to be packaged so that the plastic film web 1 is delivered from the film web roll 5, forming a wrapping around the object to be packaged. When the ring arrangement 33 supporting the film dispenser 2 is simultaneously moved vertically by moving the lifting frame 32, a spiral wrapping is produced around the object to be packaged.

It is to be noted that other known arrangements can also be used to circulate the film dispenser 2 on a circular path, for instance an arrangement wherein the film dispenser 2 is connected to a rotating crank which circulates the film dispenser around the object to be packaged.

The film dispenser 2 described in detail in the following is also usable in a wrapping machine in which the film dispenser has been arranged to be vertically movable along an upright column but in which the film dispenser does not circulate around the object to be packaged but instead the object to be packaged is rotated on a spinning support in relation to the film dispenser.

With reference to FIGS. 2–4, the film dispenser 2 comprises a skeleton frame 3. Mounted on the frame 3 are supporting elements $\mathbf{4}^1$, $\mathbf{4}^2$ for rotatably supporting the film web roll 5 on the frame 3.

The film dispenser 2 comprises a pre-stretching device 6, which is connected to the frame 3 to pre-stretch the film web 1 drawn from the film roll 5 before its being wrapped around the object. The pre-stretching device 6 comprises a first pre-stretching roller 7, which is disposed foremost in the direction of motion of the film web. The first side 8 of the film web drawn from the roll 5 is in tractive frictional contact with the outer surface of the first pre-stretching roller 7. The outer surface of the roller 7 is preferably provided with a rubber coating to ensure a frictional grip.

The second pre-stretching roller 9 is rotatably mounted with bearings on the frame 3 at a distance from the first pre-stretching roller 7 so that a first gap ($s_{1I}$, see FIGS. 2 and 4; similarly $s_{1II}$, see FIGS. 5 and 7) is formed between the first and the second pre-stretching rollers. The second side 10 of the film web 1 is in frictional contact with the outer surface of the rim of the second pre-stretching roller 9. The outer surface of the roller 9 is preferably provided with a rubber coating to ensure a frictional grip.

The film dispenser 2 further comprises a first power transmission wheel 11, which is mounted at the end of the shaft of the first pre-stretching roller 7. A second power transmission wheel 12 is mounted at the end of the second pre-stretching roller 9. In FIG. 2, the first power transmission wheel 11 and the second power transmission wheel 12 are in tractive contact with each other. The power transmission wheels 11 and 12 are preferably toothed gears having different diameters so as to produce a transmission ratio that will result in a difference between the circumferential velocities of the first and second pre-stretching rollers. Usually the circumferential velocity of the second pre-stretching roller 9 is higher than the circumferential velocity of the first pre-stretching roller 7.

The film dispenser 2 further comprises a first deflecting pinch roller 13, which has been fitted to be pressed against the first pre-stretching roller 7 to form a first nip 14 (see FIG. 4) for the film web passed between the first deflecting pinch roller 13 and the first pre-stretching roller 7. Similarly, a second deflecting pinch roller 15 has been fitted to be pressed against the second pre-stretching roller 9 to form a second nip 16 for the film web passed between the second deflecting pinch roller 15 and the second pre-stretching roller 9.

A lever mechanism 17 has been arranged to move the first pre-stretching roller 7 between an engagement position I (see FIGS. 2–4) and a disengagement position II (see FIGS. 5–7). It is to be noted that in the figures presented as an example the space required by the lever mechanism in the vertical direction above the upper ends of the rollers and correspondingly below the lower ends of the rollers is exaggerated for the sake of clarity. In practice, the mechanism can be implemented in a very low and compact form.

When the lever mechanism 17 is in the engagement position I, the power transmission wheels 11, 12 are in tractive contact. In the disengagement position II, the power transmission wheels 11, 12 are disengaged from each other so that the pre-stretching rollers 7, 9 can be rotated independently of each other. In the disengagement position II, the first gap $s_{1II}$ between the pre-stretching rollers 7, 9 is larger than the corresponding first gap $s_{1I}$ in the engagement position.

When the lever mechanism 17 is moved from the engagement position I to the disengagement position II, the lever mechanism 17 has been arranged to simultaneously move the first deflecting pinch roller 13 apart from the first pre-stretching roller 7 so as to form a second gap $s_2$ between the first deflecting pinch roller 13 and the first pre-stretching roller 7, and at the same time to move the second deflecting pinch roller 15 apart from the second pre-stretching roller 9 so as to form a third gap $s_3$ between the second deflecting pinch roller 15 and the second pre-stretching roller 9, the first, second and third gaps being thus increased simultaneously by a single movement of the lever mechanism.

The film dispenser 2 comprises a power means 18, e.g. an electric motor, which is supported on the frame 3 and has a rotating shaft 19 and power transmission means 20 for the transmission of power from the shaft 19 to rotate the second pre-stretching roller 9. In the embodiment illustrated in the figures, the power transmission means 20 comprise a first belt pulley 34, which is mounted on the shaft of the second pre-stretching roller 9, a second belt pulley 35, which is mounted on the shaft 19 of the motor 8, and an endless drive belt 36 running over the belt pulleys 34, 35.

As can be best seen from FIGS. 3, 6 and 8, the lever mechanism 17 comprises a reversal lever 21 pivotally connected to the frame 3 so as to be turnable about a first swivel axis 22. The first pre-stretching roller 7 is rotatably mounted on the reversal lever 21 at a distance from the first swivel axis 22. The reversal lever 21 comprises an elongated first swinging arm 23, which extends to a distance from the first swivel axis 22 to serve as a grip handle for manual operation of the reversal lever 21.

The first deflecting pinch roller 13 is connected to a second swinging arm 24, which is pivotally connected to the frame 3 so as to be turnable about a second swivel axis 25. The reversal lever 21 comprises a first transmission element 26 for translating the swinging motion of the reversal lever 21 into a swinging motion of the second swinging arm 24. The second deflecting pinch roller 15 is connected to a third swinging arm 27, which is pivotally connected to the frame 3 so as to be turnable about the second swivel axis 25, and the reversal lever 21 comprises a second transmission element 28 for translating the swinging motion of the reversal lever 21 into a swinging motion of the third swinging arm 27.

The first transmission element 26 and/or the second transmission element 28 is a pin or the like extending from the reversal lever 21 to the path of the turning motion of the second swinging arm 24 and/or the third swinging arm 26 at a distance from the second swivel axis 25 of the second swinging arm and/or the third swinging arm so that the pin 26, 28 or the like in question pushes the swinging arm 24, 27 concerned when the reversal lever 21 is being turned from the engagement position I to the disengagement position II.

A spring 29 has been fitted to impose a load on the second swinging arm 24 to press the first deflecting pinch roller 13 against the first pre-stretching roller 7. The same spring 29 has been fitted to impose a load on the third swinging arm 27 to press the second deflecting pinch roller (15) against the second pre-stretching roller 9. The spring 29 functions as a return spring to pull back the second swinging arm 24 and the third swinging arm 27 when the reversal lever 21 is turned from the disengagement position II back to the engagement position I.

To keep the reversal lever 21 in the disengagement position II, the frame 3 is provided with a latch element 37, which in FIG. 5 is in a hold position preventing the reversal lever 21 from being returned to the engagement position I by the action of the force of the spring 29.

FIG. 8 further visualizes the positions of the lever mechanism 17 and the rollers 13, 7, 9 and 15 in the engagement position I (solid lines) and in the disengagement position II (dot-and-dash lines). To form sufficiently large gaps $s_2$, $s_{1II}$, $s_3$ (see FIG. 7) allowing easier thread-in of the film web end, a fairly small movement of the swinging arm 23 is sufficient.

The invention is not limited to the embodiment examples described above; instead, many variations are possible within the scope of the inventive concept defined in the claims.

The invention claimed is:

1. A wrapping machine for wrapping a wrapping film web around an object to be packaged, said wrapping machine comprising a film dispenser, which comprises:

a frame;

supporting elements for rotatably supporting a roll of said film web on the frame; and a pre-stretching device connected to the frame for pre-stretching the film web drawn from the roll before the drawn film web is wrapped around the object, said pre-stretching device comprising:

a first pre-stretching roller having an outer surface adapted to be brought into tractive frictional contact with a first side of the film web drawn from the roll;

a second pre-stretching roller mounted via bearings on the frame so as to be rotatable at a distance from the first pre-stretching roller to form a first gap between the pre-stretching rollers, said second pre-stretching roller having an outer surface adapted to be brought into tractive frictional contact with a second side of the film web drawn from the roll, said second side being opposite said first side;

a first transmission gear which is mounted on a shaft of the first pre-stretching roller;

a second transmission gear, which is mounted on a shaft of the second pre-stretching roller and adapted to be engaged with the first transmission gear to produce a transmission ratio so as to differentiate circumferential velocities of the first and second pre-stretching rollers;

a first deflecting pinch roller, which is adapted to be pressed against the first pre-stretching roller to form a first nip for the film web passed between the first deflecting pinch roller and the first pre-stretching roller;

a second deflecting pinch roller, which is adapted to be pressed against the second pre-stretching roller to form a second nip for the film web passed between the second deflecting pinch roller and the second pre-stretching roller; and a lever mechanism arranged to move the first pre-stretching roller between an engagement position and a disengagement position;

wherein in the engagement position, the transmission gears are engaged;

in the disengagement position, the transmission gears are disengaged, the pre-stretching rollers are rotatable independently of each other, and the first gap between the pre-stretching rollers is larger than in the engagement position;

when the lever mechanism is moved from the engagement position to the disengagement position, the lever mechanism is adapted to move the first deflecting pinch roller apart from the first pre-stretching roller to form a second gap between the first deflecting pinch roller and the first pre-stretching roller, and to simultaneously move the second deflecting pinch roller apart from the second pre-stretching roller to form a third gap between the second deflecting pinch roller and the second pre-stretching roller, the first, second and third gaps being thus increased simultaneously by a single movement of the lever mechanism; and the lever mechanism comprises:

a reversal lever, which is pivotally mounted on the frame so as to be rotatable about a first swivel axis, the first pre-stretching roller being rotatably mounted via a bearing on said reversal lever at a distance from the first swivel axis; and a swinging arm to which one of the first and second deflecting pinch rollers is connected, and which is pivotally connected to the frame so as to be rotatable about a second swivel axis, wherein the reversal lever comprises a first transmission element for translating a swinging motion of the reversal lever into a corresponding swinging motion of the swinging arm.

2. The wrapping machine according to claim 1, wherein the film dispenser further comprises:

a driving element having a rotating shaft and connected to the frame, and a power transmission element for transmitting power from the rotating shaft of the driving element to rotate the second pre-stretching roller.

3. The wrapping machine according to claim 1, wherein the reversal lever comprises a further, elongated swinging arm, which extends to a distance from the first swivel axis to serve as a grip handle for manual operation of the reversal lever.

4. The wrapping machine according to claim 1, wherein the first deflecting pinch roller is connected to said swinging arm; and the lever mechanism further comprises a further swinging arm to which the second deflecting pinch roller is connected, and which is pivotally connected to the frame so as to be rotatable about the second swivel axis, wherein the reversal lever further comprises a second transmission element for translating the swinging motion of the reversal lever into a corresponding swinging motion of said further swinging arm.

5. The wrapping machine according to claim 4, further comprising a spring adapted to impose a load on said swinging arm to press the first deflecting pinch roller against the first pre-stretching roller, and to impose a load on said further swinging arm to press the second deflecting pinch roller against the second pro-stretching roller, the spring thus functioning as a return spring to pull back the swinging arms when the reversal lever is turned from the disengagement position to the engagement position.

6. The wrapping machine according to claim 4, wherein each of the first and second transmission elements is a pin extending from the reversal lever to a path of the swinging motion of the respective swinging arm at a distance from the second swivel axis of the respective swinging arm so that the pin pushes the respective swinging arm when the reversal lever is being turned from the engagement position to the disengagement position.

7. The wrapping machine according to claim 6, further comprising a spring adapted to impose a load on said swinging arm to press the first deflecting pinch roller against the first pre-stretching roller, and to impose a load on said further swinging arm to press the second deflecting pinch roller against the second pre-stretching roller, the spring thus functioning as a return spring to pull back the swinging arms when the reversal lever is turned from the disengagement position to the engagement position.

8. The wrapping machine according to claim 1, wherein the first transmission element is a pin extending from the reversal lever to a path of the swinging motion of the swinging arm at a distance from the second swivel axis of the swinging arm so that the pin pushes the swinging arm when the reversal lever is being turned from the engagement position to the disengagement position.

9. A wrapping machine for wrapping a wrapping film web around an object to be packaged, said wrapping machine comprising a film dispenser, which comprises:

a frame;

supporting elements for rotatably supporting a roll of said film web on the frame; and a pre-stretching device supported by the frame for pre-stretching the film web drawn from the roll before the drawn film web is wrapped wound the object, said pre-stretching device comprising:

first and second pm-stretching rollers adapted to be brought into contact with the film web drawn from the roll;

a first transmission gear mounted on a shaft of the first pm-stretching roller;

a second transmission gear mounted on a shaft of the second pre-stretching roller and engageable with the first the transmission gear;

a lever mechanism moveable between (i) an engagement position in which the transmission gears are engaged, and (ii) a disengagement position in which the transmission gears are disengaged and a first gap between the pre-stretching rollers is greater than in the engagement position;

a first deflecting pinch roller which, when the lever mechanism is in the engagement position, is pressed against the first pre-stretching roller to form a first nip for the film web passed between the first deflecting pinch roller and the first pre-stretching roller; and a second deflecting pinch roller which, when the lever mechanism is in the engagement position, is pressed against the second pre-stretching roller to form a second nip for the film web passed between the second deflecting pinch roller and the second pre-stretching roller;

wherein when the lever mechanism is moved from the engagement position to the disengagement position, the lever mechanism moves (a) the first deflecting pinch roller apart from the first pre-stretching roller to form a second gap between the first deflecting pinch roller and the first pre-stretching roller, and (b) the second deflecting pinch roller apart from the second pre-stretching roller to form a third gap between the second deflecting pinch roller and the second pre-stretching roller, the first, second and third gaps being thus increased by a single movement of the lever mechanism, and (c) the first pre-stretching roller and the second deflecting pinch roller relative to each other.

10. The wrapping machine according to claim 9, wherein when the lever mechanism is moved from the engagement position to the disengagement position, the lever mechanism moves the first pre-stretching roller and the second deflecting pinch roller away from each other.

11. The wrapping machine according to claim 10, wherein when the lever mechanism is moved from the engagement position to the disengagement position, the lever mechanism further moves the second pre-stretching roller and the first deflecting pinch roller away from each other.

12. The wrapping machine according to claim 9, wherein the lever mechanism comprises:

a lever pivotally mounted on the frame, the first pre-stretching roller being rotatably mounted on said lever; and a swinging arm on which the second deflecting pinch roller is pivotally mounted;

wherein dining a swinging motion of the lever from the engagement position to the disengagement position, the lever is engageable with said swinging arm for translating the swinging motion of the lever into a corresponding swinging motion of the swinging arm.

13. The wrapping machine according to claim 12, wherein said lever comprises a projection extending into a path of the swinging motion of the swinging arm for pushing the swinging arm during the swinging motion of the lever from the engagement position to the disengagement position.

14. The wrapping machine according to claim 12, wherein the lever mechanism further comprises a further swinging arm on which the first deflecting pinch roller is pivotally mounted; and during the swinging motion of the lever from the engagement position to the disengagement position, the lever is engageable with said further swinging arm for translating the swinging motion of the lever into a corresponding swinging motion of said further swinging arm.

15. The wrapping machine according to claim 14, wherein said lever comprises first and second projection each extending into a path of the swinging motion of one of the swinging arms for pushing said swinging arm during the swinging motion of the lever from the engagement position to the disengagement position.

16. The wrapping machine according to claim 14, further comprising a spring biasing said swinging arms to press the first and second deflecting pinch rollers against the first and second pre-stretching rollers, respectively.

17. The wrapping machine according to claim 16, wherein said spring is connected between said swinging arms and biases said swinging arms towards each other.

18. The wrapping machine according to claim 17, further comprising a latch for locking said lever in the disengagement position against a biasing force of said spring.

19. The wrapping machine according to claim 9, further comprising a return spring biasing said lever mechanism into the engagement position; and a latch for locking said lever mechanism in the disengagement position against a biasing force of said spring.

20. A film dispenser for use in a wrapping machine for wrapping a wrapping film web around an object to be packaged, said film dispenser comprising a frame;

supporting elements for rotatably supporting a roll of said film web on the frame; and a pre-stretching device supported by the frame for pro-stretching the film web drawn from the roll before the drawn film web is wrapped around the object, said pre-stretching device comprising:

first and second pre-stretching rollers adapted to be brought into contact with the film web drawn from the roll;

a first transmission gear mounted on a shaft of the first pre-stretching roller;

a second transmission gear mounted on a shaft of the second pro-stretching roller and engageable with the first the transmission gear;

a lever mechanism moveable between (i) an engagement position in which the transmission gears are engaged, and (ii) a disengagement position in which the transmission gears are disengaged and a first gap between the pre-stretching rollers is greater than in the engagement position;

a first deflecting pinch roller which, when the lever mechanism is in the engagement position, is pressed against the first pro-stretching roller to form a first nip for the film web passed between the first deflecting pinch roller and the first pro-stretching roller; and a second deflecting pinch roller which, when the lever mechanism is in the engagement position, is pressed against the second pre-stretching roller to form a second nip for the film web passed between the second deflecting pinch roller and the second pro-stretching roller;

wherein when the lever mechanism is moved from the engagement position to the disengagement position, the lever mechanism moves (a) the first deflecting pinch roller apart from the first pre-stretching roller to form a second gap between the first deflecting pinch roller and the first pre-stretching roller, and (b) the second deflecting pinch roller apart from the second pro-stretching roller to form a third gap between the second deflecting pinch roller and the second pre-stretching roller, the first, second and third gaps being thus increased by a single movement of the lever mechanism, and (c) the first pre-stretching roller and the second deflecting pinch roller relative to each other.

* * * * *